US005657616A

United States Patent [19]

Schreiber, Jr.

[11] Patent Number: 5,657,616

[45] Date of Patent: Aug. 19, 1997

[54] ROLL WRAPPING MACHINE WITH ROLL ORIENTER AND METHOD

[75] Inventor: John J. Schreiber, Jr., New Freedom, Pa.

[73] Assignee: Elsner Engineering Works, Inc., Hanover, Pa.

[21] Appl. No.: 582,335

[22] Filed: Jan. 18, 1996

[51] Int. Cl.[6] ..... B65B 11/00

[52] U.S. Cl. ..... 53/466; 53/449; 53/463; 53/493; 53/176; 53/229; 53/586

[58] Field of Search ..... 53/118, 176, 228, 53/229, 216, 586, 430, 449, 463, 466, 493

[56] References Cited

U.S. PATENT DOCUMENTS

| | | | |
|---|---|---|---|
| 3,523,402 | 8/1970 | West et al. | 53/229 X |
| 3,659,394 | 5/1972 | Hartleib et al. . | |
| 3,775,939 | 12/1973 | Elsner et al. . | |
| 3,866,389 | 2/1975 | Elsner et al. | 53/229 X |
| 3,990,215 | 11/1976 | Elsner et al. . | |
| 4,423,584 | 1/1984 | Elsner et al. . | |
| 4,432,187 | 2/1984 | Elsner et al. | 53/176 X |
| 4,700,529 | 10/1987 | Bargholtz et al. . | |
| 4,757,667 | 7/1988 | Elsner . | |
| 4,826,551 | 5/1989 | Ingram . | |
| 5,299,411 | 4/1994 | Yamamoto et al. . | |
| 5,305,578 | 4/1994 | Menayan . | |
| 5,428,941 | 7/1995 | Staub . | |

*Primary Examiner*—Daniel Moon
*Attorney, Agent, or Firm*—Thomas Hooker, P.C.

[57] ABSTRACT

A roll wrapping machine includes a roll infeed conveyor; a roll wrapping station having a film curtain, sealing bars and a pusher for pushing the roll into the curtain and past the bars; and a roll orienter on the infeed conveyor. The orienter receives each roll fed down the conveyor, spins the roll and releases the roll with the roll tail in a known circumferential location so that the tail of the roll is in the six o'clock position when the roll is received at the wrapping station and is not caught between the plastic curtain film during sealing.

20 Claims, 5 Drawing Sheets

ROLL WRAPPING MACHINE WITH ROLL ORIENTER AND METHOD

FIELD OF THE INVENTION

The invention relates to machines and methods for wrapping plastic film envelopes around pre-wound rolls of stiffly flexible web material, typically small diameter rolls of gift-wrap paper.

DESCRIPTION OF THE PRIOR ART

Small rolls of paper are conventionally wound from a continuous web of paper by a winding machine with free outer ends or tails. The rolls are delivered to a wrapping machine. This machine includes an infeed conveyor and a curtain wrapper. The conveyor rotates the roll downstream between conveyor belts and hold-down bars and delivers the rolls to the curtain wrapper. The curtain wrapper pushes each roll into a film curtain and through an opening between a pair of seal bars. After the roll and curtain have been pushed between the seal bars, the seal bars close to seal overlapping portions of the film together and form a film envelope surrounding the roll. The bars also reseal the film together to re-establish the curtain and sever the wrapped roll and film envelope from the curtain.

Prior roll low speed wrapping machines have used roll orienters to locate the tail of the roll and assured the roll was received at the curtain wrapper with the tail in a circumferential position so that it did not interfere with sealing.

In one machine, the orienter included a pair of stationary belts located at the height of the hold-down bar. When a roll was rotated down the hold-down bars and onto the motionless orienter belts, a sensor was triggered to start a motor driving the belts to move the belts upstream and spin the roll in place between the orienter belts and the conveyor belts. The web tail was thrown out from the spinning roll and triggered a light beam sensor which immediately turned off the motor to stop the orienter belts and release the roll for delivery to the roll wrapping station. The position of the light beam sensor along the conveyor was adjusted so that the roll was released at a position on the infeed conveyor for delivery to the roll wrapping station with the tail at the six o'clock position. In this way, the tail was held against the roll and did not extend out between the sheets of plastic during sealing.

A second roll wrapping machine included a roll orienter like the roll orienter of the first machine but with a light beam sensor which was fixed at one position on the infeed conveyor. Rolls were fed to and along the stationary orienter belts, and were then sensed to turn on a motor and move the orienter belts upstream to spin the roll in place between the orienter belts and the conveyor belts. The tail of the roll was thrown out from the roll and to break a light beam sensor, as in the first roll wrapping machine. In the second machine, however, the sensor initiated a timing interval the orienter belts continued to be moved upstream during the timing interval. At the end of the interval the orienter motor and belt were stopped and the roll was fed downstream by the conveyor belts and delivered to the wrapping station with the tail at the six o'clock position. This machine was adjustable for different diameter rolls by raising and lowering the hold-down bars and orienter and by varying the duration of the interval. There was no need to adjust the light beam sensor upstream and downstream on the conveyor to assure that the roll was delivered to the wrapping station with the tail at the six o'clock position.

The prior roll wrapping machines worked when rolls were wrapped at rates up to about 50 rolls per minute. However, at rates greater than 50 rolls per minute the machines were not capable of accurately positioning the tails of the rolls at the wrapping stations. The inability to assure that the rolls were properly oriented during wrapping prevented increasing the speed of both the roll winding machine and the roll wrapping machine and slowed production.

SUMMARY OF THE INVENTION

The invention is an improved high speed roll wrapping machine of the type having an infeed conveyor, a film curtain roll wrapping station at the downstream end of the conveyor and a high speed roll orienter located on the conveyor upstream from the roll wrapping station. The orienter includes a pair of spinning wheels located at the top of the conveyor to engage the top of a roll as the roll is rotated down the conveyor hold-down bars by conveyor belts below the bars. When a roll is rotated to the rotating wheels, the roll is spun in place between the wheels and the belts. A sensor accurately locates the tail of the spinning roll which projects outwardly from the roll and initiates a controller timing cycle. At the end of the cycle, the controller which then stops rotation of the wheels to release the roll with the tail in a known circumferential location. The roll then is rotated further down the conveyor and delivered to the roll wrapping station with the tail of the roll at the six o'clock position where it will be held against the roll during wrapping and cannot extend between the plastic film layers during closing of the clamp bars and sealing. The high speed roll wrapping machine operates at speeds as much as 33 percent faster than the previously described conventional wrapping machines.

Additionally, the two wheel roll orienter accurately aligns skewed rolls to assure that the rolls are released from the orienter extending transversely to the conveyor and are received in transverse orientation at the wrapping station for proper wrapping.

Other objects and features of the invention will become apparent as the description proceeds, especially when taken in conjunction with the accompanying drawings illustrating the invention, of which there are 5 sheets and one embodiment.

DESCRIPTION OF THE PREFERRED EMBODIMENT

Figure 1:
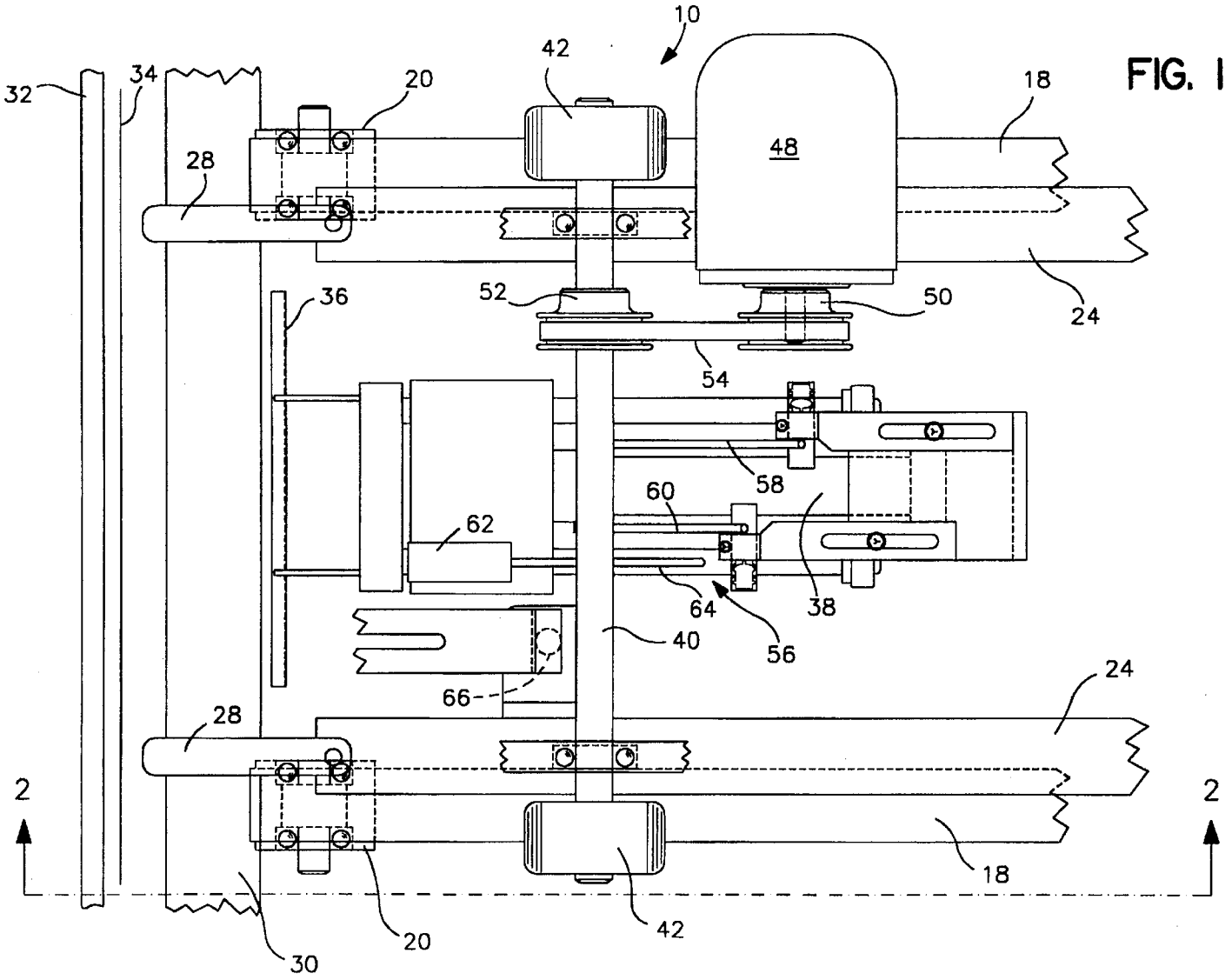
FIG. 1 is a top view of a portion of a roll wrapping machine showing the roll orienter.

Roll wrapping machine 10 includes an infeed conveyor 12 which receives rolls wound from lengths of stiffly flexible web material, typically wrapping paper, from a roll winding machine. The rolls are wound with free ends or tails. The conveyor rotates the rolls to a roll wrapping station 14 where rolls are wrapped within envelopes of plastic film. The wrapped rolls are subsequently heated to shrink the film onto the roll.

Roll orienter 16 is positioned on conveyor 12 a distance upstream from station 14 and automatically operates to orient the trailing tail end of the roll so that the tail is located in the six o'clock position when the roll is delivered to the wrapping station.

Roll infeed conveyor 12 includes a pair of spaced lower feed belts 18. The downstream ends of the belts adjacent the roll wrapping station 14 are wound around rollers 20. The horizontal runs of belts 18 are fed downstream in the direction of arrow 22 at a constant speed by a conventional motor drive (not illustrated). Two hold-down bars 24 are located above and slightly inwardly from belts 18. Resilient high friction strips 26 are provided on the lower surfaces of the bars to frictionally engage rolls fed down conveyor 12. Strips 26 may be formed from a rubber material. A roll deflector 28 is mounted on the downstream end of each hold-down bar 24. The guides extend downwardly from the bars and guide rolls on conveyor 12 down to the roll wrapping station 14.

Station 14 includes a roll support platform 30, a pair of film clamp and sealing bars 32 and a film curtain 34 extending between the bars and the platform. Roll pusher plate 36 is located above the platform and is movable between a retracted position shown in FIGS. 1–4 and a fully extended position (not illustrated) by a fluid cylinder 38.

Each roll delivered by conveyor 12 falls onto the platform 30 with cylinder 38 and the pusher plate in the retracted position. Extension of the cylinder 38 moves the pusher plate 36 toward the open bars 32 to push the roll against the curtain and fully past the open clamp bars 32. After the roll has been pushed past the clamp bars, the cylinder 38 are retracted and the bars are closed on the ends of the film curtain to form a seal in the curtain, forming an envelope surrounding the roll and a seal which re-establishes the curtain. At the same time, the closed bars sever the film between the seals to free the wrapped roll from the curtain. After wrapping has been completed, the wrapped roll is conveyed through a heating tunnel which heats and shrinks the film envelope on the roll.

U.S. Pat. No. 3,990,215, discloses a prior roll wrapping machine with a roll infeed conveyor and roll wrapping station similar to the conveyor 12 and station 14 of the machine 10. The disclosure of U.S. Pat. No. 3,990,215 is incorporated herein by reference.

Roll orienter 36 includes a rotary shaft 40 mounted bearings on the frame of machine 10 and extending transversely across the feed conveyor a distance above hold-down bars 24. Roll spin wheels 42 are mounted on the ends of shaft 40 a slight distance outwardly of the hold-down bars 24 and over belts 18, as shown in FIG. 1. The wheels extend a slight distance below the friction strips 26 on bars 24. Gaps or spaces 44 are provided in strips 26 at wheels 42. See FIG. 2.

Figure 2:
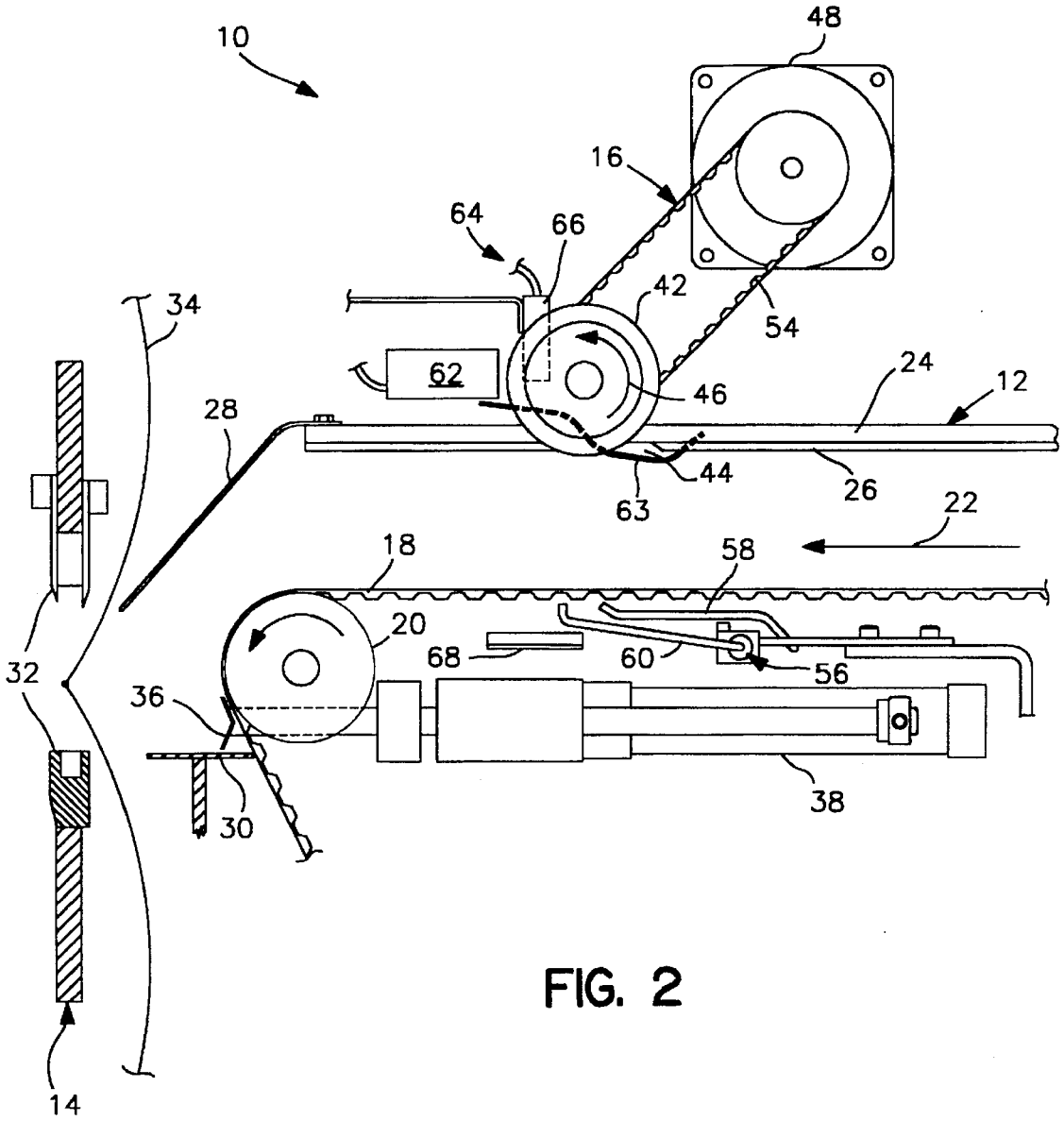
FIGS. 2–5 are views taken generally along line 2–2 of FIG. 1 showing different positions of the machine.

During operation of machine 10, the shaft and wheels are rotated in the direction of arrow 46 shown in FIG. 2 by stepping motor 48 mounted on the frame of machine 10, pulley 50 on the stepping motor, pulley 52 on shaft 40 and belt 54 which is wrapped around the pulleys. Motor 48 rotates the wheels to move the lower portion of wheels upstream at a circumferential speed slightly greater than the downstream speed of belts 18 in the direction of arrow 22. Belts 18 rotate a roll fed into the conveyor downstream against bars 24 until the top of the roll engages the rotating wheels 42, at which time the roll is captured between the wheels 42 and the belt and is spun in place. The slight overspeed of wheels 42 assures that the spinning roll is not fed downstream past the wheels. The gaps 44 in the friction strips 26 assure that the strips do not engage spinning rolls.

The roll orienter 16 includes an air assembly 56. The assembly 56 is located between and beneath belts 18 as shown in FIG. 1 and includes two air delivery tubes 58 and 60 each having a discharge nozzle located beneath wheels 42, as shown in FIG. 2. The nozzle of tube 60 is located downstream of the discharge end of tube 58 and is aimed vertically. The nozzle of tube 58 is angled downstream at about 30 degrees above the horizontal. As shown in FIG. 1, the tubes 58 and 60 are spaced apart laterally between belts 18. Both tubes are connected to a source of compressed air through a solenoid control valve. The source and valve are not illustrated in the drawings.

The control valve for the air delivery tubes is opened in response to closing of a microswitch 62 mounted on the frame of machine 10 above and between the hold-down bars 14. The switch 62 has a trigger 64 angled down below the level of friction strips 26 immediately upstream from wheels 42 as shown in FIG. 2. Movement of a roll down conveyor 12 raises trigger 63 to close switch 62, shift the valve in the air assembly and flow compressed air through tubes 58 and 60. The compressed air jets hold out the tail of the web wound into the roll as the roll is spun in place on the conveyor between belts 18 and rollers 42, as will be described more fully herein. Air assemblies like assembly 56 have been used in prior roll wrapping machines.

Figure 4:
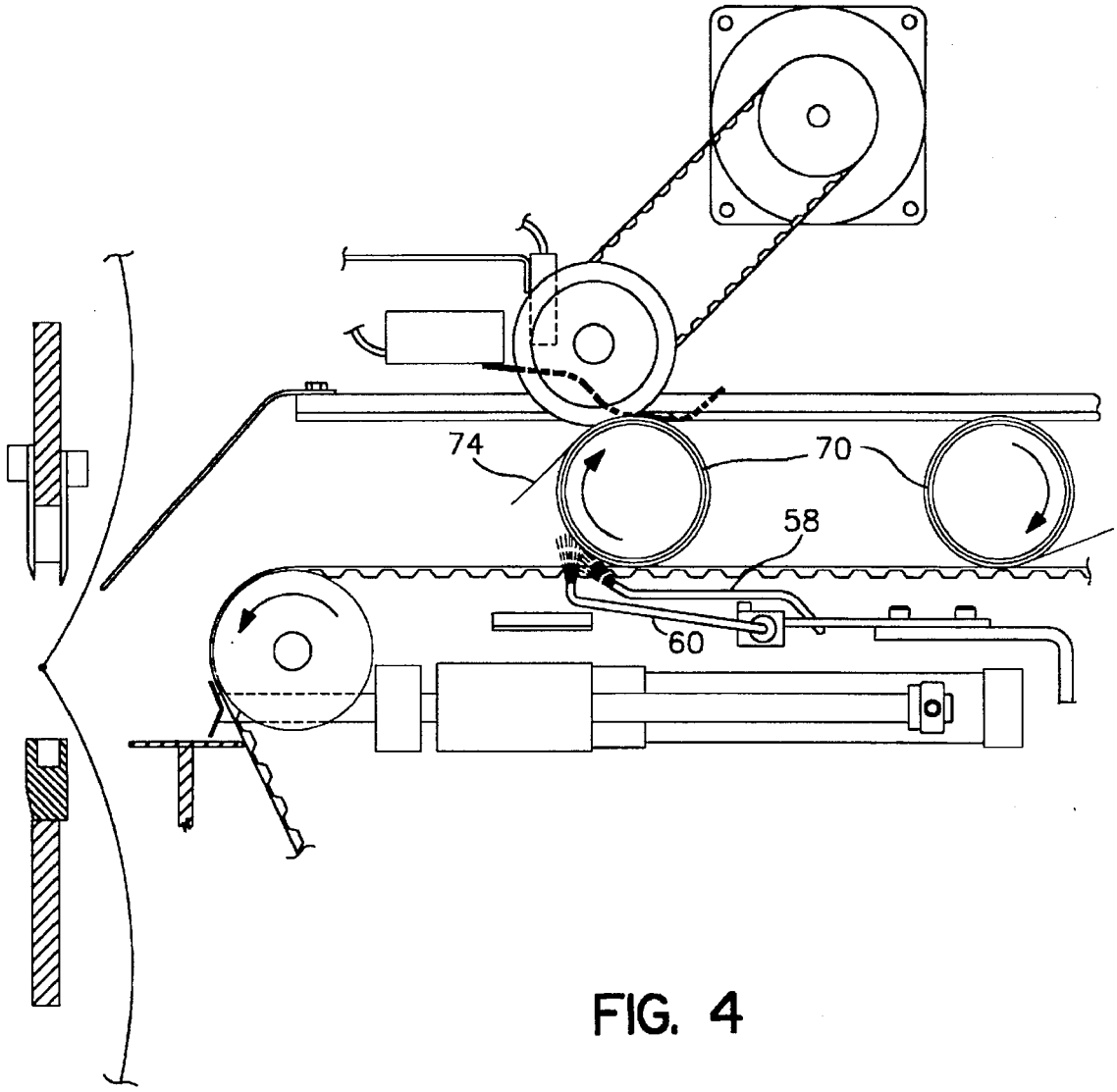
Figure 5:
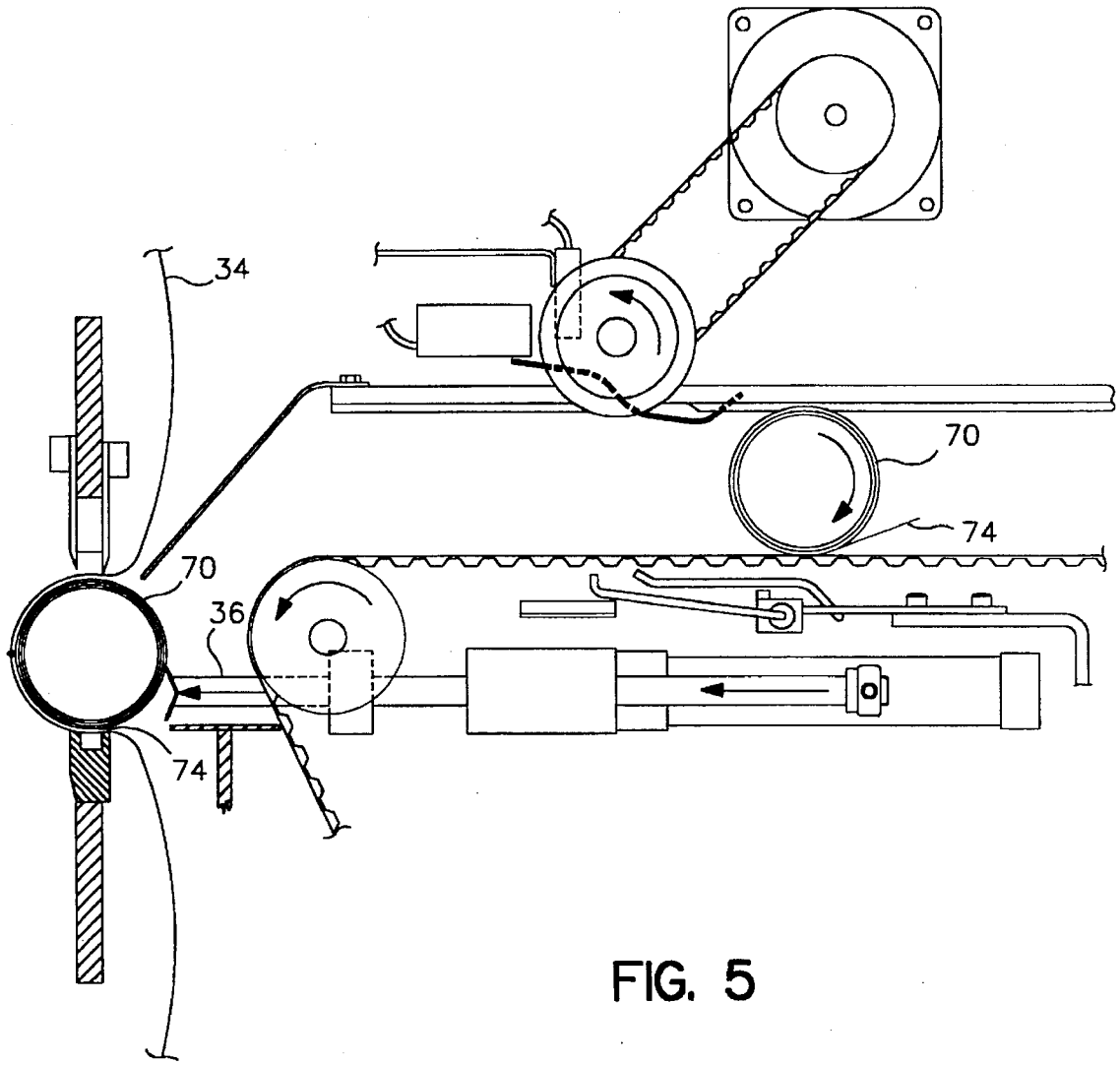

The roll orienter 16 also includes a light beam sensor 64 for detecting the tail of a spinning held between belts 18 and the wheels 42. The sensor includes a light source and detector element 66 mounted on the frame of machine 10 between the hold-down bars a short distance downstream from shaft 40 and a mirror 68 located below belts 18 and under element 66. The mirror receives a light beam from the element 66 and reflects the beam back to the element. When a roll is spun clockwise between the belts and hold-down bars, as shown in FIG. 4, the tail of the web extends outwardly from the roll and breaks the light beam extending from the element to the mirror and back at a time when the tail is in a known circumferential position on the roll. When the break occurs, the element 60 generates a signal which is transmitted through a lead to a programmable logic controller (PLC) (not illustrated) which controls motor 48. The PLC is programmed to turn off motor 48 after the timing interval less than the time required to spin the roll 360 degrees. When the stepping motor is turned off, wheels 42 immediately stop rotation and continuously downstream moving belts 24 rotate the roll downstream from the stationary wheels 42 and deliver the roll to the wrapping station 14. Use of a stepping motor permits the very accurate starting and stopping of wheels 42 required for high speed orienting of rolls.

The duration of the PLC timing interval is determined in order to release the roll for downstream movement to the wrapping station so that the tail of the roll is located in the six o'clock or bottom position when the roll is placed on platform 30 in position to be pushed into the film curtain. The tail is held on the roll and is out of the way of the clamp bars when closed on the film.

Operation of the roll wrapping machine 10 will now be described in detail.

Figure 3:
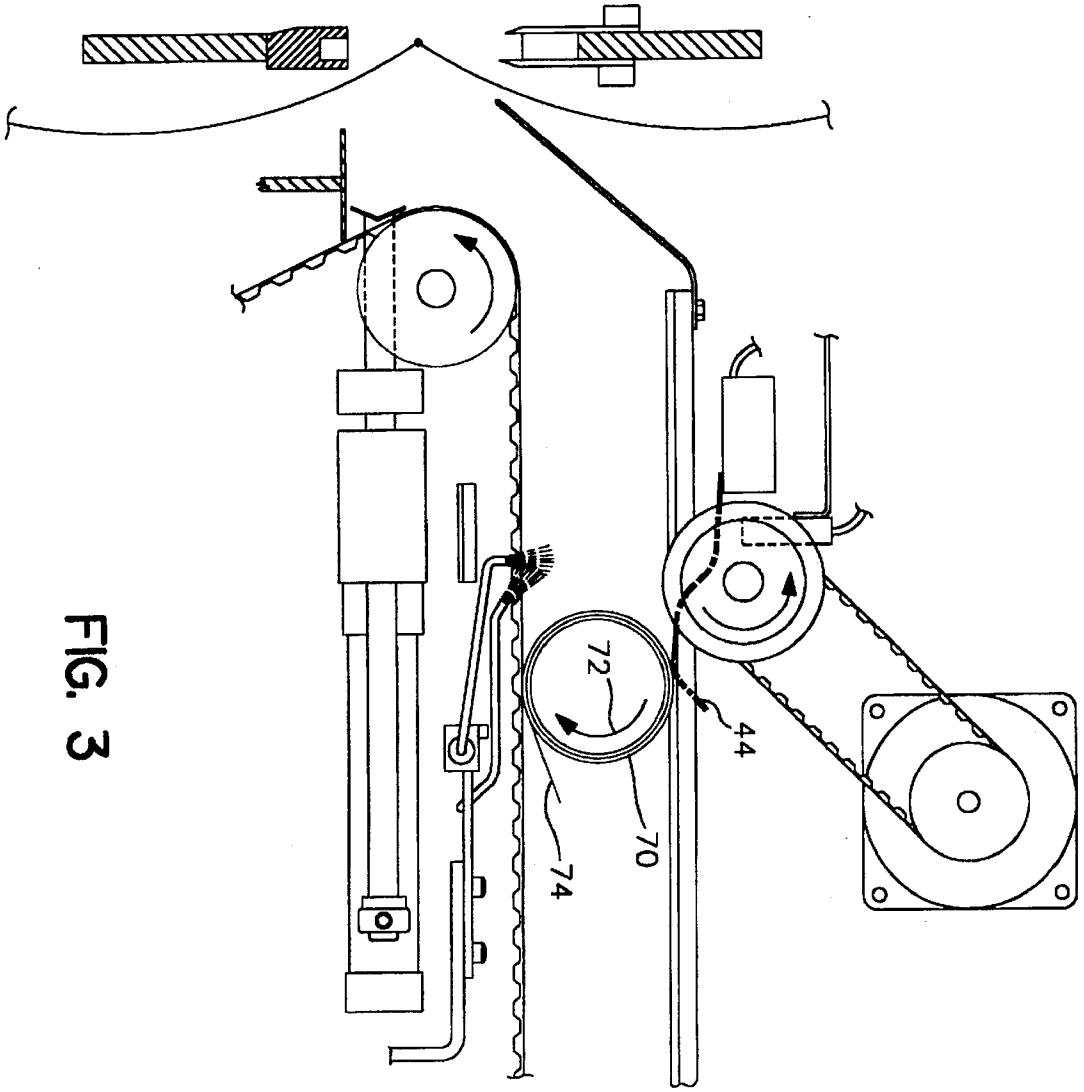

Roll wrapping machine 10 is positioned adjacent a conventional roll winding machine and receives helical wound paper rolls 70 from the winding machine. Rolls 70 with randomly oriented free tails are delivered to the upstream end of roll infeed conveyor 12 between belts 18 and hold-down bars 24. The belts move downstream continuously and rotate the rolls downstream against the friction strips on the hold-down bars in the direction of arrow 72. The rolls are wound with the free ends or tails 74 of the web extending from the outside of the roll in a direction opposite to the direction of arrow 72. The stiffness of the paper tends to hold the tail 74 outwardly from the roll, as shown in FIG. 3, although the tail is bent in against the roll by engagement with the belts, hold-down bars, and wheels. During feeding of the roll down the conveyor, motor 48 is on and wheels 42 are rotated in the direction of arrow 46 at a circumferential speed slightly greater than the downstream speed of belts 18. The conveyor belts move each roll into engagement with wheels 42 which, in cooperation with belts 18, spin the roll in place as shown in FIG. 4.

FIG. 3 shows the position of a roll 70 which has been moved down conveyor a sufficient distance to engage and lift trigger 63 of microswitch 62. Lifting of the trigger 63 actuates switch 62 to shift the valve in the air line leading to tubes 58 and 60 to provide a vertical air jet from the nozzle of tube 60 and a down-stream angled air jet from the nozzle of tube 58. As shown in FIG. 4, these air jets are directed against the downstream side of the spinning roll just above belts 18. The jets are directed in the direction of rotation to open the tail as it is rotated out of contact with belts 18. See FIG. 4. The outwardly projecting tail breaks the light beam extending from element 66 to the mirror 68 and back to the element. The first break of the light beam by the tail is sensed by the element to start the timing interval of the PLC and continue rotation of wheels 42 and spinning of the roll during the timing interval.

The tail is in a known circumferential start position when it breaks the beam for the first time. During the timing interval the roll is spun between the belts and the wheels at a speed twice the speed it is rotated down conveyor 12. At the end of the PLC timing interval the tail end is located in a known circumferential position on the roll less than 360 degrees from the start position. The PLC automatically stops stepping motor 48 at the end of the interval to immediately stop rotation of the wheels 42. At this time, continued downstream movement of belts 18 rotate the roll 70 downstream against the motionless wheels, the hold-down bars and, as the belts move around rollers 20, the roll guides 28 to deposit the roll on platform 30 in position to be pushed against the curtain and between the seal bars. The roll 70 rotates a fixed number of degrees during movement from the spinning position to the position on the platform 30.

The length of the timing interval is adjusted to assure that the roll is placed on the platform with the tail 74 held closed at the six o'clock position at the bottom of the roll. With the roll in this position, extension of the pusher plate 36 moves the roll through the curtain and open sealing bars with the end 74 maintained closed on the roll. The tail does not extend out from the roll and is not captured between the sealing bars when the bars close to seal the roll in a film envelope and re-establish the curtain.

The roll orienter assures that each roll is circumferentially oriented in the same six o'clock position when placed on the platform independent of the circumferential location of the tail when the roll is fed into the wrapping machine.

After motor 47 has been stopped to release a roll from the orienter and the roll has been rolled downstream out of contact with the wheels 42, the PLC automatically restarts stepping motor 48 so that the wheels 42 are rotated in the direction of arrow 46 prior to engagement with the next upstream roll on the conveyor.

The roll wrapping machine operates at a high rate of speed and is particularly adapted to accurately orient and wrap rolls of paper or other stiffly flexible web material have a diameter from about 1.25 inches to about 3 inches. Rolls are reliably oriented and wrapped at a rate as great as 66 rolls per minute. When the machine operates at this speed, belts 18 move downstream at about 200 feet per minute and the rolls rotate down the conveyor at about 100 feet per minute. Rolls are placed onto conveyor 12 by the roll winding machine in close proximity, but with sufficient spacing between adjacent rolls to assure that each roll is spun, oriented, and released from the roll orienter prior to movement of the next roll to the orienter.

The two wheel orienter 16 also automatically aligns skewed rolls rotated down conveyor 12. When a skewed roll is placed on the infeed conveyor with one end in front of the other end, the conveyor will rotate the roll downstream until a lead end engages one of the rotating drive wheels 42. This end of the roll will be spun slowly between the wheel and the adjacent conveyor belt while the upstream other end of the roll is rotated downstream between the other belt and other hold-down bar until it reaches the other wheel and the entire roll is spun as described previously. During orienting of a skewed roll, the roll is pivoted about one drive wheel as it is brought into contact with the other drive wheel.

When a roll is moved into and is captured by the roll orienter, initial rotation of the roll does not extend the tail 74 sufficiently to break the light beam sent and received by the sensor 64. The web tail is extended as shown in FIG. 4 after a few rotations and then breaks the beam to initiate the timing cycle and timed release required to assure that the roll is received on platform 28 with the tail in the six o'clock position.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. Apparatus for wrapping a film envelope around a roll of web material with a free tail, the apparatus including a roll infeed conveyor having a downstream end, the conveyor including a first movable conveyor belt, a conveyor drive connected to the belt for moving the conveyor belt in a downstream direction toward the roll wrapping station, and a first hold-down member located a distance from the belt; a roll wrapping station adjacent the downstream end of the conveyor, and a roll orienter on the conveyor, the roll orienter including a first rotatable wheel located a distance from the belt and having an axis extending transversely to the direction of movement of the belt, a circumferential portion of the wheel facing the belt, a wheel drive connected to the wheel for rotating the wheel and moving the circumferential portion in an upstream direction at a speed approximately equal to the downstream speed of the belt, a tail-location sensor on the conveyor adjacent to the wheel, and a time interval controller joining the tail-location sensor and the wheel drive to stop the wheel drive and rotation of the wheel after actuation of the tail location sensor by the tail of a roll spun between the wheel and the belt and expiration of a timing interval.

2. Apparatus as in claim 1 wherein the portion of the wheel and the hold-down member are each located approximately the same distance from the belt.

3. Apparatus as in claim 1 wherein the tail-location sensor is located downstream of the wheel axis.

4. Apparatus as in claim 1 wherein the wheel drive includes a stepping motor.

5. Apparatus as in claim 4 including a second rotatable wheel spaced from and co-axial with the first rotatable wheel, said wheel drive connected to the second rotatable wheel.

6. Apparatus as in claim 5 wherein the infeed conveyor includes a second belt and a second hold-down member, said conveyor drive connected to the second belt; and said wheels and hold-down members are generally located over said belts.

7. Apparatus as in claim 6 including an air assembly located below said belts and including an air jet nozzle aimed above the belts, and a switch for actuating the assembly to flow air through said nozzle; said switch including a trigger positioned between the belts and the hold-down members upstream of said wheel axis.

8. Apparatus as in claim 1 wherein said roll wrapping station includes a roll support platform located at the downstream end of the infeed conveyor, film seal bars, a roll pusher plate movable between a retracted position upstream of the platform and an extended position downstream of the platform and a plate drive for moving the plate between said positions.

9. Apparatus as in claim 8 wherein said platform is located below the infeed conveyor.

10. Apparatus as in claim 9 including a roll guide at the downstream end of the conveyor.

11. Apparatus for wrapping a film envelope around a roll of web material with a free tail, the apparatus including a roll infeed conveyor having a downstream end, the conveyor including first and second spaced conveyor belts, a conveyor drive connected to the belts for moving the belts in a downstream direction, and first and second hold-down members spaced from the belts; a roll wrapping station at the downstream end of the infeed conveyor, the conveyor including a roll platform, a pair of clamp and seal bars located downstream of the platform, a bar drive operable to move the bars between open and closed positions, and a roll pusher member normally located upstream of the roll platform and movable to a position downstream of the platform, a plate drive connected to the plate for moving the plate between said positions; a roll orienter including a rotary shaft extending transversely across the infeed conveyor a distance from the downstream end of the conveyor, a pair of roll orienting wheels on the shaft, each wheel located adjacent one of the conveyor belts and including a circumferential portion facing the belt at the level of an adjacent hold-down member, a wheel drive connected to the shaft for rotating the wheels and moving the circumferential portions in an upstream direction at a speed approximately equal to the downstream speed of the belts, a tail-location sensor on the conveyor adjacent the wheels, and a time interval controller joining the tail-location sensor and the wheel drive to stop the wheel drive and rotation of the wheels after actuation of the tail-location sensor by the tail of a roll spun between the wheels and the belts and expiration of a timing interval.

12. Apparatus as in claim 11 wherein said plate drive is located below said belts.

13. Apparatus as in claim 11 wherein said platform is located below said belts.

14. Apparatus as in claim 12 including roll guides extending downwardly from the downstream ends of the hold-down bars.

15. Apparatus as in claim 11 including a compressed air nozzle located below said belts and aimed upwardly, a switch connecting a source of compressed air to said nozzle, the switch including a trigger located between the belts and the hold-down bars.

16. The method of wrapping a plastic film envelope around a roll of web material with a free tail using a roll wrapping apparatus including an infeed conveyor, a roll orienter and a roll wrapping station, including the steps of:

A) feeding a roll along the infeed conveyor to the roll orienter;

B) spinning the roll at the roll orienter between a rotating wheel engaging the roll and moving upstream and a belt moving downstream to move the tail end of the roll outwardly from the roll;

C) sensing the circumferential location of the tail on the spinning roll, initiating a timing interval and spinning the roll during the timing interval;

D) stopping rotation of the wheel at the end of the timing interval with the tail in a known circumferential location while continuing downstream movement of the conveyor;

E) moving the roll downstream along the conveyor and delivering the roll to the roll wrapping station with the tail in a known circumferential location; and F) actuating the roll wrapping station to wrap the roll within a plastic film envelope with the tail in the envelope.

17. The method of claim 16 including the step of rotating the roll along the infeed conveyor against a hold-down member spaced from the conveyor.

18. The method of claim 16 including the step of moving the roll past the downstream end of the infeed conveyor and placing the roll on a roll platform located below the infeed conveyor.

19. The method of claim 16 including the step of spinning the roll for less than 360 degrees during the timing interval.

20. The method of claim 16 including the step of moving the wheel upstream slightly faster than the conveyor moves downstream.

* * * * *